US010556736B1

(12) United States Patent
Guevara

(10) Patent No.: US 10,556,736 B1
(45) Date of Patent: Feb. 11, 2020

(54) BABY BOTTLE WITH JOINABLE DRY GOODS SECTION AND LIQUID SECTION

(71) Applicant: Kenneth Guevara, Sherman Oaks, CA (US)

(72) Inventor: Kenneth Guevara, Sherman Oaks, CA (US)

( * ) Notice: Subject to any disclaimer, the term of this patent is extended or adjusted under 35 U.S.C. 154(b) by 129 days.

(21) Appl. No.: 15/839,747

(22) Filed: Dec. 12, 2017

Related U.S. Application Data

(60) Provisional application No. 62/434,645, filed on Dec. 15, 2016.

(51) Int. Cl.
*B65D 81/32* (2006.01)
*A61J 9/00* (2006.01)

(52) U.S. Cl.
CPC ..... *B65D 81/3211* (2013.01); *A61J 9/008* (2013.01)

(58) Field of Classification Search
USPC ..... 215/6
See application file for complete search history.

(56) References Cited

U.S. PATENT DOCUMENTS

| | | | | |
|---|---|---|---|---|
| 2,326,414 | A | 1/1940 | Thompson | |
| 3,405,899 | A | 10/1968 | Trachtenberg | |
| 3,732,999 | A | 5/1973 | Rounkles | |
| 4,427,123 | A | 1/1984 | Komeda | |
| 5,040,719 | A | 8/1991 | Ballway | |
| 5,086,926 | A | 2/1992 | Paige | |
| 5,535,889 | A | 7/1996 | Lin | |
| 5,829,607 | A | 11/1998 | Ibrahim | |
| 6,145,685 | A | 11/2000 | Dick | |
| 6,179,146 | B1 | 1/2001 | Betras | |
| 6,719,159 | B2 | 4/2004 | Chomik | |
| 7,614,512 | B2 | 11/2009 | Nader | |
| 7,798,346 | B2 | 9/2010 | Nelson | |
| 7,914,165 | B2 | 3/2011 | Bertken | |
| 8,365,941 | B2 | 2/2013 | Mayer | |
| 8,459,450 | B1 * | 6/2013 | Whitaker | A61J 9/00 206/219 |
| 8,474,648 | B1 | 7/2013 | Ritzen | |
| 8,504,127 | B2 | 8/2013 | Altschul | |
| 2002/0035997 | A1 * | 3/2002 | Shapira | A61J 9/00 128/898 |

(Continued)

*Primary Examiner* — Shawn M Braden
(74) *Attorney, Agent, or Firm* — Eric Kelly

(57) ABSTRACT

A baby bottle with a liquid compartment and a separate dry goods compartment is described. The dry goods compartment and the liquid compartment may be removably sealable from each other by rotating a lower-annular-member with respect to an upper-annular-member; wherein these two annular-members may be disposed between a bottle-main-body and a nipple-member. Each of these two annular-members may have its own respective opening and shelf-portion and may be rotated with respect to each other from an open-configuration to a closed-configuration. In the closed-configuration, dry goods, such as dry baby formula, may be temporarily stored within the dry goods compartment, in a substantially dry condition, separated from a liquid within the liquid compartment. When desired these two annular-members may be rotated into the open-configuration, to allow the dry goods to substantially fall into the liquid compartment, to facilitate mixing with the liquid in the liquid compartment.

14 Claims, 3 Drawing Sheets

(56) References Cited

U.S. PATENT DOCUMENTS

| | | | | |
|---|---|---|---|---|
| 2006/0201900 | A1 | 9/2006 | de Francesco | |
| 2009/0188884 | A1 | 7/2009 | Nelson | |
| 2013/0037506 | A1* | 2/2013 | Wahlstrom | A61J 1/2093 215/6 |
| 2014/0238949 | A1 | 8/2014 | Patel | |
| 2014/0374370 | A1 | 12/2014 | Nowzari | |
| 2016/0023825 | A1* | 1/2016 | Van Den Broek | B65D 81/3211 215/227 |
| 2016/0038378 | A1* | 2/2016 | Al-Hakim | B65D 81/3211 206/221 |
| 2016/0198877 | A1 | 7/2016 | Ni | |
| 2016/0221721 | A1 | 8/2016 | Ni | |
| 2017/0049663 | A1* | 2/2017 | Arends | A61J 9/001 |

* cited by examiner

BABY BOTTLE WITH JOINABLE DRY GOODS SECTION AND LIQUID SECTION

PRIORITY NOTICE

The present application claims priority under 35 U.S.C. § 119(e) to U.S. Provisional Patent Application Ser. No. 62/434,645 filed on Dec. 15, 2016, the disclosure of which is incorporated herein by reference in its entirety.

TECHNICAL FIELD OF THE INVENTION

The present invention relates in general to baby bottles and more specifically to a baby bottle with a dry goods compartment and a separate liquid compartment; wherein the contents of each respective compartment may be kept separated or may be allowed in contact with other.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

When babies (e.g., human babies) are hungry, they let their parents and/or caregivers, along with others nearby, know by crying, kicking, twisting, slapping, and so forth; i.e., by the hungry baby being generally agitated and fussy. When this happens, the parents and/or the caregivers may be forced to drop everything, find place to put down their stuff, and "make a bottle" by mixing dry baby formula with water and having said mixture placed into a baby bottle for feeding the hungry baby. No matter how long it takes to "make the bottle," babies do not understand and will continue to fuss and be agitated, which can be highly stressful and/or annoying for parents, caregivers, and/or others in the nearby vicinity. Additionally, it can be a hassle to tote around separate containers of dry baby formula, baby bottles, and water bottles with water—if the parents and/or the caregivers even remember to grab such items before leaving.

There is a need in the art for a solution to these problems.

It is to these ends that the present invention has been developed.

BRIEF SUMMARY OF THE INVENTION

To minimize the limitations in the prior art, and to minimize other limitations that will be apparent upon reading and understanding the present specification, some embodiments of the present invention may describe a baby bottle comprising a liquid compartment and a separate dry goods compartment. In some embodiments, the dry goods compartment and the liquid compartment may be removably sealable from each other by rotating a lower-annular-member with respect to an upper-annular-member; wherein these two annular-members may be disposed between a bottle-main-body and a nipple-member. In some embodiments, each of these two annular-members may have its own respective opening and a solid wall shelf-portion and these two annular-members may be rotated with respect to each other from an open-configuration to a closed-configuration or vice-versa. In the closed-configuration, dry goods, such as dry baby formula, may be temporarily stored within the dry goods compartment, in a substantially dry condition, separated from a liquid within the liquid compartment. When desired these two annular-members may be rotated into the open-configuration, to allow the dry goods to substantially fall into the liquid compartment, to facilitate mixing with the liquid in the liquid compartment.

It is an objective of the present invention to provide a baby bottle with a liquid compartment and a separate dry goods compartment, so that both water (or another liquid) and dry goods, such as dry baby formula, may be stored together in the same bottle for convenience and efficiencies.

It is another objective of the present invention to provide such a baby bottle wherein the contents of the liquid compartment and the separate dry goods compartment may be kept separate or allowed to mix when desired.

It is yet another objective of the present invention to provide such a baby bottle wherein the dry goods compartment may be located directly above the liquid compartment, so when mixing is desired, gravity may facilitate transferring the contents of the dry goods compartment into the liquid compartment.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERALS

Figure 1:
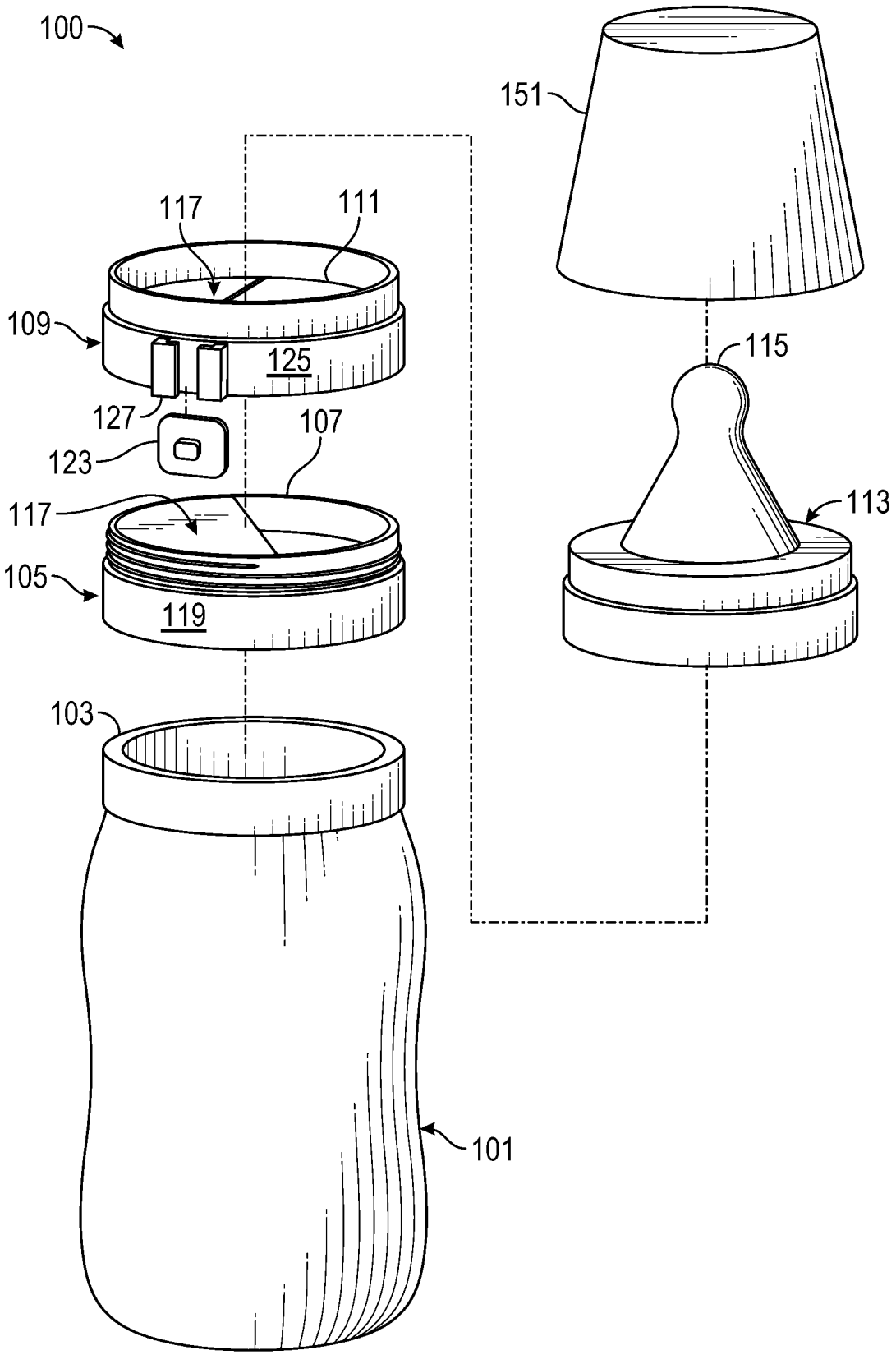
FIG. 1 may depict an exploded perspective view of a baby bottle with a liquid compartment and a dry goods compartment.

100 baby bottle 100
101 bottle-main-body 101

103 upper-opening 103
105 lower-annular-member 105
107 first-dry-goods-passage-opening 107
109 upper-annular-member 109
111 second-dry-goods-passage-opening 111
113 nipple-member 113
115 nipple-portion 115
117 shelf-portion 117
119 exterior-side-wall 119
121 lower-receiving-channel 121
123 locking-member 123
125 exterior-side-wall 125
127 upper-receiving-channel 127
129 flange 129
131 straight-edge-portion 131
133 straight-edge-portion 133
151 lid 151

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1 may depict an exploded perspective view of a baby bottle with a liquid compartment and a dry goods compartment. This baby bottle with the liquid compartment and the dry goods compartment may be known herein as baby bottle 100. In some embodiments, the dry goods compartment and the liquid compartment may be removably sealable from each other. In some embodiments, when baby bottle 100 may be standing upright upon some substrate (e.g., a table-top), the dry goods compartment may be located above the liquid compartment. This may allow dry goods, such as dry baby formula, to be temporarily stored within the dry goods compartment, in a substantially dry condition, separated from a liquid within the liquid compartment; and then when desired, to allow the dry goods to substantially fall into the liquid compartment, to facilitate mixing with the liquid in the liquid compartment.

Discussing FIG. 1, in some embodiments, baby bottle 100 may comprise: a bottle-main-body 101, a lower-annular-member 105, an upper-annular-member 109, and a nipple-member 113. In some embodiments, the bottle-main-body 101 may be removably attached to the lower-annular-member 105, e.g., via a threaded connection. In some embodiments, the lower-annular-member 105 may be removably attached to the upper-annular-member 109, in a manner that permits at least some rotational translation between the lower-annular-member 105 and the upper-annular-member 109. In some embodiments, the connection between the lower-annular-member 105 and the upper-annular-member 109 may be a threaded connection; whereas, in other embodiments, this may be a snap fit and/or a friction fit. In some embodiments, the nipple-member 113 may be removably attached to the upper-annular-member 109; such as by a threaded connection, a snap fit, and/or a friction fit.

Continuing discussing FIG. 1, in some embodiments, the bottle-main-body 101 may comprise sides (e.g., side walls), a bottom, and an upper-opening 103. In some embodiments, the bottom may be disposed opposite of the upper-opening 103. In some embodiments, upper-opening 103 may be an opening to the bottle-main-body 101 (and in some embodiments, may be the only such opening to the bottle-main-body 101). In some embodiments, the sides and the bottom may be solid members that are substantially non-liquid permeable. In some embodiments, the sides of bottle-main-body 101, and the bottom of bottle-main-body 101 may substantially form the liquid compartment, with a top of the liquid compartment being located at upper-opening 103. In some embodiments, the sides and the bottom of the bottle-main-body 101 may be attached to each other; substantially forming a vessel capable of removably holding a predetermined volume of liquid; wherein this vessel may be the liquid compartment.

Continuing discussing FIG. 1, in some embodiments, the lower-annular-member 105 may be removably attachable to the upper-opening 103 of the bottle-main-body 101. In some embodiments, lower-annular-member 105 may be a structural member. In some embodiments, the lower-annular-member 105 may comprise a first-dry-goods-passage-opening 107. In some embodiments, first-dry-goods-passage-opening 107 may be a hole through a portion of lower-annular-member 105.

Continuing discussing FIG. 1, in some embodiments, the upper-annular-member 109 may be rotationally attached to the lower-annular-member 105. In some embodiments, upper-annular-member 109 may be a structural member. In some embodiments, the upper-annular-member 109 may comprise a second-dry-goods-passage-opening 111. In some embodiments, second-dry-goods-passage-opening 111 may be a hole through a portion of the upper-annular-member 109.

Continuing discussing FIG. 1, in some embodiments, a bottom of the nipple-member 113 may be removably attachable to a top of the upper-annular-member 109. In some embodiments, disposed opposite of the bottom of the nipple-member 113 may be a nipple-region 115 with nipple structure to function as a nipple of the baby bottle; i.e., to allow passage of a liquid when the nipple-region 115 is sucked on by a baby. In some embodiments, the nipple-region 115 may be substantially a soft elastomer, such as, but not limited to a silicone.

Continuing discussing FIG. 1, in some embodiments, the lower-annular-member 105 and the upper-annular-member 109 each may comprise its own shelf-portion 117 that may solid (i.e., substantially non-liquid permeable). In some embodiments, the first-dry-goods-passage-opening 107 may be disposed opposite of its respective shelf-portion 117. In some embodiments, the first-dry-goods-passage-opening 107 and its respective shelf-portion 117 share a common plane of the lower-annular-member 105; wherein, in some embodiments, this common plane may be located at a top of lower-annular-member 105. In some embodiments, the second-dry-goods-passage-opening 111 may be disposed opposite of its respective shelf-portion 117. In some embodiments, the second-dry-goods-passage-opening 111 and its respective shelf-portion 117 may share a common plane of the upper-annular-member 109; wherein, in some embodiments, this common plane may be located about the middle of upper-annular-member 109.

In some embodiments, there is a rotational-relationship between the lower-annular-member 105 and the upper-annular-member 109. In some embodiments, this rotational-relationship exists in two operational configurations, a closed-configuration and an open-configuration. For example, and without limiting the scope of the present invention, FIG. 1 (in an exploded state) and FIG. 3A may show the open-configuration; whereas, FIG. 2 (in an exploded state) and FIG. 3B may show the closed-configuration. In the closed-configuration, the first-dry-goods-passage-opening 107 and the second-dry-goods-passage-opening 111 are not aligned with each other (e.g., not concentric with each other) such that contents of the dry goods compartment are removably separated from mixing with contents of the liquid compartment. Whereas, in the open-configuration, the first-dry-goods-passage-opening 107 and the second-dry-goods-passage-opening 111 may be at least partially aligned with each other such that there is a continuous open passage from the dry goods compartment to the liquid compartment. The dry goods compartment may be located from a shelf-portion 117 of upper-annular-member 109 and into the nipple-member 113.

Continuing discussing FIG. 1, in some embodiments, the shelf-portion 117 of the lower-annular-member 105 may be located at a top of the lower-annular-member 105. In some embodiments, the shelf-portion 117 of the upper-annular-member 109 may be located at a middle of upper-annular-member 109.

In some embodiments, when the rotational-relationship is in the closed configuration each of the two shelf-portions 117 form a continuous and solid wall that separates the dry goods compartment from the liquid compartment. This continuous and solid wall (formed from the two shelf-portions 117) may be the bottom of the dry goods compartment. See e.g., FIG. 2 and FIG. 3B.

In some embodiments, when the rotational-relationship is in the open configuration, a portion of a bottom surface of shelf-portion 117 of upper-annular-member 109 may be in physical contact with a portion of a top surface of shelf-portion 117 of lower-annular-member 105. See e.g., FIG. 1 and FIG. 3A.

Continuing discussing FIG. 1, in some embodiments, the baby bottle may further comprise a lid 151. In some embodiments, the lid 151 may removably cover the nipple-portion 115. In some embodiments, the lid 151 may be removably attachable to the nipple-member 113. In some embodiments, the lid 151 may be removably attachable to the upper-annular-member 109. In some embodiments, the lid 151 may be removably attachable to the lower-annular-member 105. In some embodiments, removable attachment of the lid 151 to the nipple-member 113, or to the upper-annular-member 109, or to the lower-annular-member 105 is by a friction snap connection or by a threaded connection. In some embodiments, the lid 151 may be substantially transparent to aid viewing of the nipple-portion 115 without having to remove the lid 151.

Figure 2:
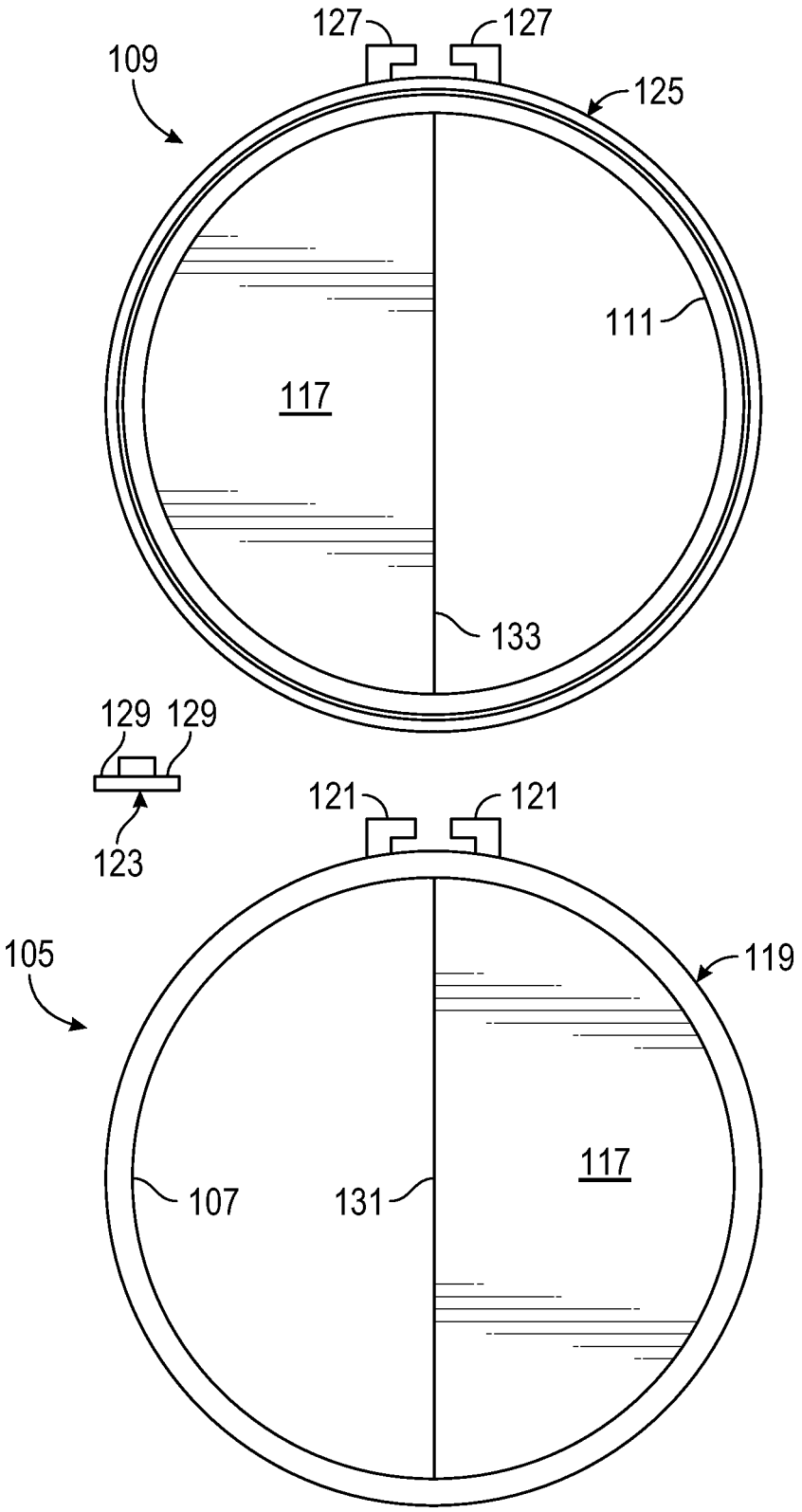
FIG. 2 may depict a lower-annular-member and an upper-annular-member of the baby bottle of FIG. 1; wherein the lower-annular-member and the upper-annular-member are shown side by side from a top view.

FIG. 2 may depict the lower-annular-member 105 and the upper-annular-member 109 of the baby bottle 100; wherein the lower-annular-member 105 and the upper-annular-member 109 are shown side by side from a top view. FIG. 2 may also show lower-annular-member 105 and upper-annular-member 109 in the closed-configuration, but in an exploded state from each other, in that when upper-annular-member 109 is placed on (or over) and attached to the lower-annular-member 105, keeping the alignment shown in FIG. 2, their respective receiving-channels (e.g., lower-receiving-channel 121 for the lower-annular-member 105 and upper-receiving-channel 127 for the upper-annular-member 109) are aligned and their respective shelf-portions 117 may then form the bottom of the dry goods compartment.

Discussing FIG. 2, in some embodiments, the first-dry-goods-passage-opening 107 and the second-dry-goods-passage-opening 111 may be of substantially a same shape and/or a same size. In some embodiments, when the rotational-relationship is in the open-configuration the first-dry-goods-passage-opening 107 and the second-dry-goods-passage-opening 111 are substantially concentric with each other; i.e., in FIG. 2 either lower-annular-member 105 or upper-annular-member 109 (but not both) would be rotated 180 degrees from the view of FIG. 2. to show alignment of the open-configuration.

Continuing discussing FIG. 2, in some embodiments, the first-dry-goods-passage-opening 107 and the second-dry-goods-passage-opening 111 may be substantially shaped as a semi-circle. In other embodiments, a shape and a size of the first-dry-goods-passage-opening 107 and the second-dry-goods-passage-opening 111 may be substantially the same, but that shape may be other than a semi-circle shape.

Continuing discussing FIG. 2, in some embodiments, the lower-annular-member 105, on an exterior-side-wall 119 of the lower-annular-member 105 may comprise a lower-receiving-channel 121 for removably receiving at least a portion of a locking-member 123. In some embodiments, the baby bottle 100 may further comprise the locking-member 123. See also FIG. 1, FIG. 3A, and FIG. 3B for the locking-member 123. Continuing discussing FIG. 2, in some embodiments, the lower-receiving-channel 121 may be formed from a pair of spaced ridges that extend away from the exterior-side-wall 119. See also FIG. 3A and FIG. 3B. Continuing discussing FIG. 2, in some embodiments, each of these spaced ridges selected from the pair of spaced ridges may substantially L-shaped when the lower-annular-member 105 is viewed from above, such that a receiving-channel is formed along a portion of the exterior-side-wall 119.

Continuing discussing FIG. 2, in some embodiments, the upper-annular-member 109, on an exterior-side-wall 125 of the upper-annular-member 109 may comprise an upper-receiving-channel 127 for removably receiving at least a portion of the locking-member 123. See also FIG. 3B. Continuing discussing FIG. 2, in some embodiments, the upper-receiving-channel 127 may be formed from a pair of spaced ridges that extend away from the exterior-side-wall 125. See also FIG. 1 and FIG. 3B. Continuing discussing FIG. 2, in some embodiments, each of these spaced ridges selected from the pair of spaced ridges on the exterior-sidewall 125 may be substantially L-shaped when the upper-annular-member 109 is viewed from above, such that a receiving-channel is formed along a portion of the exterior-side-wall 125.

Continuing discussing FIG. 2, in some embodiments, the first-dry-goods-passage-opening 107 may comprise a straight-edge-portion 131. In some embodiments, the second-dry-goods-passage-opening 111 may comprise a separate and different straight-edge-portion 133. In some embodiments, when the rotational-relationship is in the closed-configuration (e.g., the alignment of FIG. 2) or in the open-configuration, the straight-edge-portion 131 and the separate and different straight-edge-portion 133 may be substantially parallel with each other.

Figure 3A:
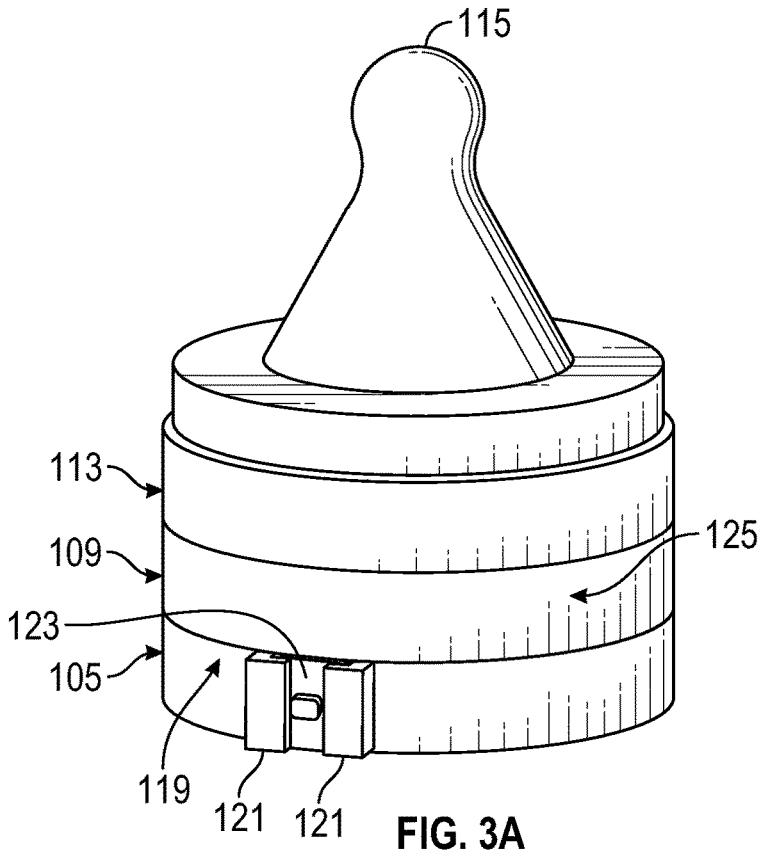
FIG. 3A may show the lower-annular-member, the upper-annular-member, and a nipple-member of the baby bottle of FIG. 1, removably assembled together, but in a non-closed-configuration with respect to a rotational-relationship between the lower-annular-member and the upper-annular-member.

FIG. 3A may show the lower-annular-member 105, the upper-annular-member 109, and a nipple-member 113 of the baby bottle 100, removably assembled together, but in a non-closed-configuration with respect to a rotational-relationship between the lower-annular-member 105 and the upper-annular-member 109. Such a non-closed-configuration could be the open-configuration. In FIG. 3A, which is not depicting the closed-configuration, the upper-receiving-channel 127 of the upper-annular-member 109 may not be shown because the lower-receiving-channel 121 of the lower-annular-member 105 may be shown; and in the non-closed-configuration (e.g., the open-configuration) these two receiving-channels are not aligned with each other.

Figure 3B:
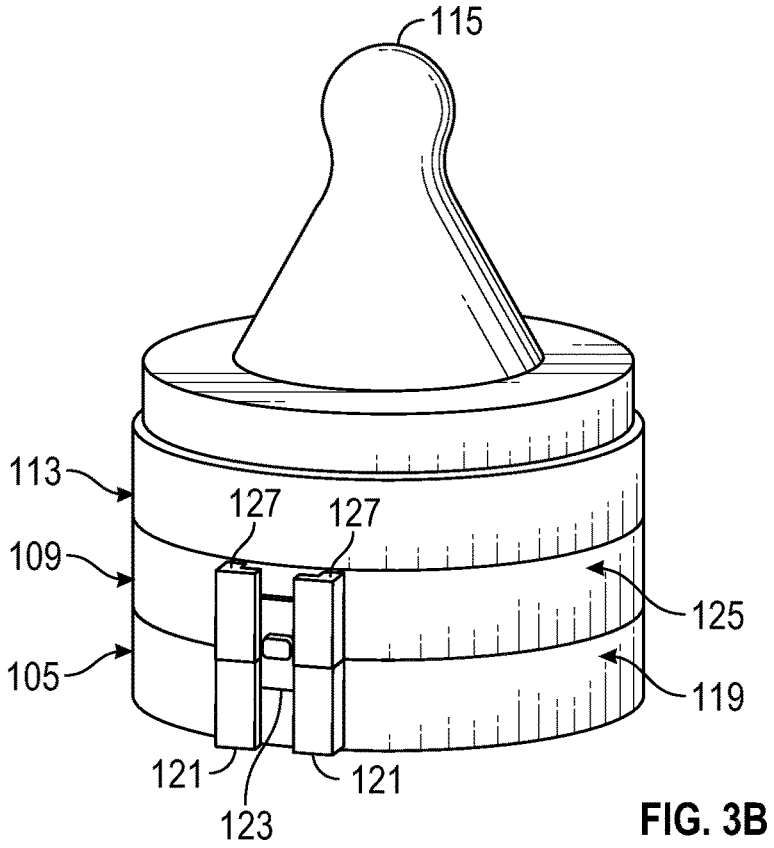
FIG. 3B may show the lower-annular-member, the upper-annular-member, and a nipple-member of the baby bottle of FIG. 1, removably assembled together, shown in a closed-configuration with respect to the rotational-relationship between the lower-annular-member and the upper-annular-member.

FIG. 3B may show the lower-annular-member 105, the upper-annular-member 109, and the nipple-member 113 of the baby bottle 100, removably assembled together, shown in a closed-configuration with respect to the rotational-relationship between the lower-annular-member 105 and the upper-annular-member 109. In FIG. 3B, the lower-receiving-channel 121 and the upper-receiving-channel 127 may be shown aligned with each other; and when these two receiving-channels are aligned with each other, the locking-member 123 may occupy portions of each of these two receiving-channels, which in turn may prevent rotational translation between the lower-annular-member 105 and the upper-annular-member 109.

Discussing FIG. 3A and FIG. 3B, the lower-annular-member 105, on the exterior-side-wall 119 of the lower-annular-member 105 may comprise the lower-receiving-channel 121 for removably receiving at least a portion of the locking-member 123. In some embodiments, the lower-receiving-channel 121 may be formed from a pair of lower spaced ridges that may extend away from the exterior-side-wall 119. In some embodiments, the upper-annular-member 109, on the exterior-side-wall 125 of the upper-annular-member 109 may comprise the upper-receiving-channel 127 for removably receiving at least a different portion of the locking-member 123. In some embodiments, the upper-receiving-channel 127 may be formed from a pair of upper spaced ridges that may extend away from the exterior-side-wall 125. In some embodiments, when the pair of lower spaced ridges are in alignment with the pair of upper spaced ridges, the rotational-relationship may be in the closed-configuration (see e.g., FIG. 3B). In some embodiments, when the lower-receiving-channel 121 and the upper-receiving-channel 127 are rotationally disposed opposite of each other (or not aligned with each other), the rotational-relationship may be in the open-configuration (see e.g., FIG. 3A).

Discussing FIG. 3B, in some embodiments, when the rotational-relationship may be in the closed-configuration, the locking-member 123 may be slidably located with portions in both the lower-receiving-channel 121 and in the upper-receiving-channel 127 to removably lock in the closed-configuration; which in turn may prevent rotational translation between the lower-annular-member 105 and the upper-annular-member 109.

In some embodiments, the locking-member 123 may comprise an annular flange 129, wherein it is this annular flange 129 of the locking-member 123 that may be removably captured within portions of the lower-receiving-channel 121 and within portions of the upper-receiving-channel 127. See e.g., FIG. 2, FIG. 1, FIG. 3A, and FIG. 3B.

In various embodiments, the baby bottle 100, the bottle-main-body 101, the lower-annular-member 105, the upper-annular-member 109, the nipple-member 113, the locking member 123, the lid 151, an/or portions thereof may be substantially constructed of one or more thermoplastics and/or elastomers suitable for injection molding. In some embodiments, such plastics and/or elastomers may be food grade or medical grade. In some embodiments, such plastics and/or elastomers may be BPA free. For example, and without limiting the scope of the present invention, in various embodiments these parts or portions thereof may be substantially constructed of one or more materials of acrylonitrile-butadiene styrene (ABS), polyvinyl chloride (PVC), polycarbonate, nylon, polypropylene, polyethylene (e.g., HDPE), silicones, rubbers, and/or the like.

Note with respect to the materials of construction, it is not desired nor intended to thereby unnecessarily limit the present invention by reason of such disclosure.

A baby bottle with the liquid compartment and the dry goods compartment, that are separated, but whose contents may be joined, has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A baby bottle with a dry goods compartment and a liquid compartment that are removably sealable from each other, wherein the baby bottle comprises:

a bottle-main-body with sides, a bottom, and an upper-opening; wherein the sides and the bottom are attached to each other; wherein the upper-opening is disposed opposite of the bottom; wherein the bottle-main-body substantially forms the liquid compartment;

a lower-annular-member that is removably attachable to the upper-opening of the bottle-main-body; wherein the lower-annular-member comprises a first-dry-goods-passage-opening;

an upper-annular-member that is rotationally attached to the lower-annular-member; wherein the upper-annular-member comprises a second-dry-goods-passage-opening;

a nipple-member; wherein a bottom of the nipple-member is removably attachable to a top of the upper-annular-member; wherein disposed opposite of the bottom of the nipple-member is a nipple-region with nipple structure to function as a nipple of the baby bottle;

wherein the lower-annular-member and the upper-annular-member each comprises its own shelf-portion that is solid; wherein the first-dry-goods-passage-opening is disposed opposite of its respective shelf-portion; wherein the first-dry-goods-passage-opening and its respective shelf-portion share a common plane of the lower-annular-member; wherein the second-dry-goods-passage-opening is disposed opposite of its respective shelf-portion; wherein the second-dry-goods-passage-opening and its respective shelf-portion share a common plane of the upper-annular-member;

wherein the dry goods compartment is located within the upper-annular-member and above both of the two shelf-portions;

wherein a rotational-relationship between the lower-annular-member and the upper-annular-member exists in two operational configurations a closed-configuration and an open-configuration;

wherein in the closed-configuration the first-dry-goods-passage-opening and the second-dry-goods-passage-opening are not aligned with each other such that contents of the dry goods compartment are removably separated from mixing with contents of the liquid compartment; wherein when the rotational-relationship is in the closed configuration each of the two shelf-portions form a continuous and solid wall that separates the dry goods compartment from the liquid compartment;

wherein in the open-configuration the first-dry-goods-passage-opening and the second-dry-goods-passage-opening are at least partially aligned with each other such that there is a continuous open passage from the dry goods compartment to the liquid compartment.

2. The baby bottle according to claim 1, wherein the first-dry-goods-passage-opening and the second-dry-goods-passage-opening are of substantially a same shape and a same size, such that when the rotational-relationship is in the open-configuration the first-dry-goods-passage-opening and the second-dry-goods-passage-opening are substantially concentric with each other.

3. The baby bottle according to claim 1, wherein the first-dry-goods-passage-opening and the second-dry-goods-passage-opening are substantially shaped as a semi-circle.

4. The baby bottle according to claim 1, wherein the shelf-portion of the lower-annular-member is located at a top of the lower-annular-member; wherein the shelf-portion of the upper-annular-member is located at a middle of the upper-annular-member.

5. The baby bottle according to claim 1, wherein the lower-annular-member, on an exterior-side-wall of the lower-annular-member comprises a lower-receiving-channel for removably receiving at least a portion of a locking-member; wherein the baby bottle further comprises the locking-member; wherein the lower-receiving-channel is formed from a pair of spaced ridges that extend away from the exterior-side-wall.

6. The baby bottle according to claim 5, wherein each of the spaced ridges selected from the pair of spaced ridges is substantially L-shaped when the lower-annular-member is viewed from above.

7. The baby bottle according to claim 1, wherein the upper-annular-member, on an exterior-side-wall of the upper-annular-member comprises an upper-receiving-channel for removably receiving at least a portion of a locking-member; wherein the baby bottle further comprises the locking-member; wherein the upper-receiving-channel is formed from a pair of spaced ridges that extend away from the exterior-side-wall.

8. The baby bottle according to claim 7, wherein each of the spaced ridges selected from the pair of spaced ridges is substantially L-shaped when the upper-annular-member is viewed from above.

9. The baby bottle according to claim 1, wherein the lower-annular-member, on an exterior-side-wall of the lower-annular-member comprises a lower-receiving-channel for removably receiving at least a portion of a locking-member; wherein the baby bottle further comprises the locking-member; wherein the lower-receiving-channel is formed from a pair of lower spaced ridges that extend away from the exterior-side-wall; wherein the upper-annular-member, on an exterior-side-wall of the upper-annular-member comprises an upper-receiving-channel for removably receiving at least a different portion of the locking-member; wherein the upper-receiving-channel is formed from a pair of upper spaced ridges that extend away from the exterior-side-wall; wherein when the pair of lower spaced ridges are in alignment with the pair of upper spaced ridges, the rotational-relationship is in the closed-configuration; wherein when the lower-receiving-channel and the upper-receiving-channel are rotationally disposed opposite of each other, the rotational-relationship is in the open-configuration.

10. The baby bottle according to claim 9, wherein when the rotational-relationship is in the closed-configuration, the locking-member is slidably located with portions in both the lower-receiving-channel and in the upper-receiving-channel to removably lock in the closed-configuration.

11. The baby bottle according to claim 9, wherein the locking-member comprises an annular flange, wherein it is this annular flange of the locking-member hat is removably captured within portions of the lower-receiving-channel and the upper-receiving-channel.

12. The baby bottle according to claim 1, wherein the first-dry-goods-passage-opening comprises a straight-edge-portion; wherein the second-dry-goods-passage-opening comprises a separate and different straight-edge-portion; wherein when the rotational-relationship is in the closed-configuration or in the open-configuration, the straight-edge-portion and the separate and different straight-edge-portion are substantially parallel with each other.

13. The baby bottle according to claim 1, wherein the baby bottle further comprises a lid; wherein the lid removably covers the nipple-portion.

14. A baby bottle with a dry goods compartment and a liquid compartment that are removably sealable from each other, wherein the baby bottle comprises:

a bottle-main-body with sides, a bottom, and an upper-opening; wherein the sides and the bottom are attached to each other; wherein the upper-opening is disposed opposite of the bottom; wherein the bottle-main-body substantially forms the liquid compartment;

a lower-annular-member that is removably attachable to the upper-opening of the bottle-main-body; wherein the lower-annular-member comprises a first-dry-goods-passage-opening; wherein the first-dry-goods-passage-opening comprises a straight-edge-portion;

an upper-annular-member that is rotationally attached to the lower-annular-member; wherein the upper-annular-member comprises a second-dry-goods-passage-opening; wherein the second-dry-goods-passage-opening comprises a separate and different straight-edge-portion;

a nipple-member; wherein a bottom of the nipple-member is removably attachable to a top of the upper-annular-member; wherein disposed opposite of the bottom of the nipple-member is a nipple-region with nipple structure to function as a nipple of the baby bottle;

wherein the dry goods compartment is located within the upper-annular-member;

wherein a rotational-relationship between the lower-annular-member and the upper-annular-member exists in two operational configurations a closed-configuration and an open-configuration;

wherein in the closed-configuration the first-dry-goods-passage-opening and the second-dry-goods-passage-opening are not aligned with each other such that contents of the dry goods compartment are removably separated from mixing with contents of the liquid compartment;

wherein in the open-configuration the first-dry-goods-passage-opening and the second-dry-goods-passage-opening are at least partially aligned with each other such that there is a continuous open passage from the dry goods compartment to the liquid compartment;

wherein when the rotational-relationship is in the closed-configuration or in the open-configuration, the straight-edge-portion and the separate and different straight-edge-portion are substantially parallel with each other.

* * * * *